United States Patent [19]

Fatula

[11] 3,961,737

[45] June 8, 1976

[54] SELF-CENTERING ROLLS

[75] Inventor: James J. Fatula, Perry Township, Lawrence County, Pa.

[73] Assignee: Ryman Engineering Co., Ellwood City, Pa.

[22] Filed: May 9, 1975

[21] Appl. No.: 576,090

[52] U.S. Cl. ..... 226/192; 74/241; 198/202

[51] Int. Cl.[2] ..... B65H 17/20

[58] Field of Search ..... 226/190, 191, 192, 194; 74/241; 198/202

[56] References Cited

UNITED STATES PATENTS

| | | | |
|---|---|---|---|
| 2,686,590 | 8/1954 | Sloane | 198/202 |
| 3,810,571 | 5/1974 | Fatula | 226/192 |

*Primary Examiner*—Richard A. Schacher
*Attorney, Agent, or Firm*—Martin J. Carroll

[57] ABSTRACT

A self-centering roll has two tubular end rim portions mounted on a straight shaft by means of a deflectible end web connected to the outer end of each end rim portion. Each end web includes a bearing mounted on the shaft and a compressible member extending between and connected to the bearing and associated rim portion. An inner web mounted on the shaft adjacent the inner end of each end rim portion includes an eccentric hub, bearings mounted on the eccentric hub and a member eccentric with respect to the shaft axis mounted on the outside of the bearing concentric with the bearing axis. The eccentricities of the inner webs are the same so that the rim portions rotate on axes that intersect at a point between the inner webs and are arranged at the same angle to the shaft axis. In one embodiment the end rim portions are arranged with a slight space between their adjacent ends. In a second embodiment the end rim portions are separated by a large space and a central tubular rim portion is positioned therebetween with a slight space between each end of the central rim portion and the associated end rim portion. The central rim portion is mounted on the shaft by means of webs similar to the inner webs with its axis offset but parallel to the shaft axis. A connecting web is preferably connected to the rim portions spanning the slight space between adjacent rim portions. The connecting web includes a bearing surrounding the shaft and a central compressible member extending between the adjacent rim portions. A peripheral slot is provided in the compressible member in alignment with the slight space between the rim portions.

16 Claims, 2 Drawing Figures

SELF-CENTERING ROLLS

This invention relates to self-centering rolls and more particularly to the types of rolls shown in Lorig, U.S. Pat. No. 2,593,157 dated 4-15-52 and FIGS. 5 and 6 of U.S. Pat. No. 2,817,940 dated 12-31-57. These types of rolls have been and are in successful commercial use where it is desirable to have the centering action substantially independent of the load or tension applied thereto. These rolls utilize a bent shaft which is difficult and expensive to make so that the cost of these rolls is relatively high. It is also necessary to make the rolls to order so that it is not common to keep spare rolls in stock. I, therefore, use some of the features disclosed in my prior U.S. Pat. No. 3,810,571 dated 5-14-74, which enable parts to be stocked which can be used in making up a variety of sizes of rolls.

Because the centering action depends upon the angle between the two legs of the bent shaft the rolls are not adjustable to obtain greater or less centering effect so that its uses are limited.

It is therefore an object of my invention to provide self-centering rolls with the centering action substantially independent of the load or tension applied thereto which eliminates the need of bent shafts and thus reduces the cost thereof.

Another object is to provide such a roll which is constructed of parts which may be used for many different sizes of rolls.

Still another object is to provide such a roll which is adjustable for obtaining various degrees of centering.

These and other objects will be more apparent after referring to the following specification and attached drawings in which—

Figure 1:
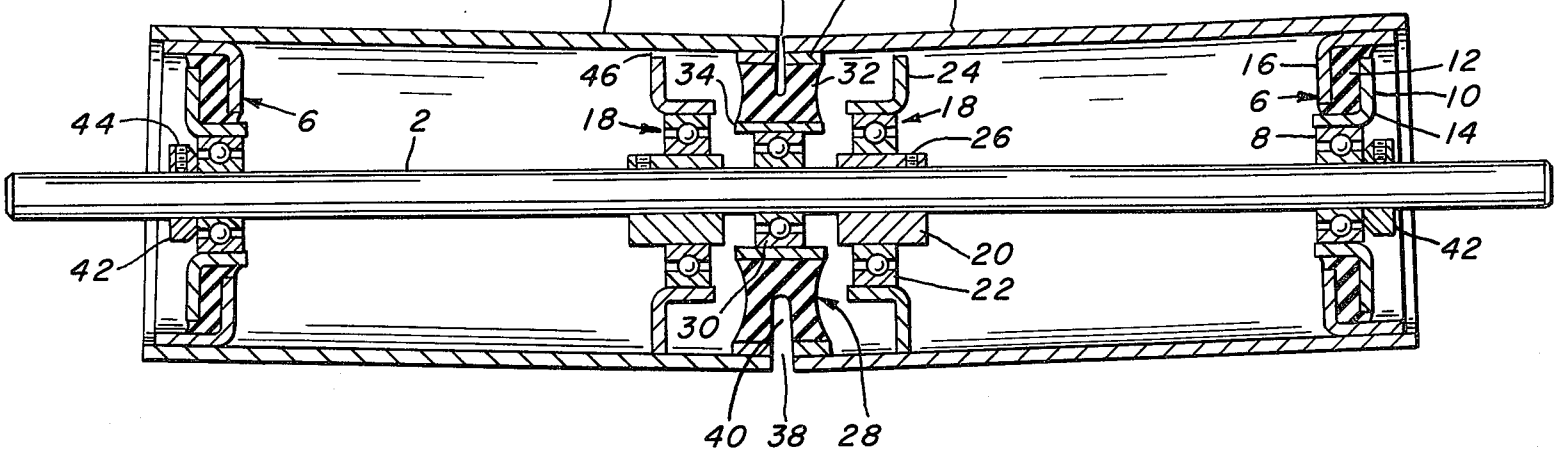
FIG. 1 is a longitudinal sectional view of a roll of my invention.

Refering more particularly to FIG. 1 of the drawings, reference numeral 2 indicates a straight shaft having two tubular end rim portions 4 surrounding it. A deflectible end web 6 mounted on each end of shaft 2 preferably includes a ball bearing 8 with a compressible member 10 extending between and attached to the rim portion 4 and bearing 8 as by welding. The compressible member 10 may be constructed in various ways such as shown in my above mentioned patent, but as shown herein consists of a rubber disk 12 sandwiched between and secured to flanged steel disks 14 and 16 which are welded to associated rim portion 4. The web 6 may also be made in other ways since it is only necessary that it permit the rim portion 4 to be deflected out of alignment with the shaft axis. In each case bearings must be provided on the roll shaft, but the deflection may be made possible by substituting a resilient metal disk in place of member 10 or by providing suitable bearings which permit a more rigid disk to be deflected. A pair of inner webs 18 are mounted on shaft 2 one adjacent the inner end of each rim portion 4. Each web 18 consists of an eccentric hub 20 surrounded by ball bearing 22 which in turn is surrounded by a radial member 24 eccentric with respect to the shaft axis but concentric with respect to the bearing axis. The outer diameter is only slightly less than the inside diameter of rim portion 4. As shown, the hub 20 is secured to shaft 2 by means of set screw 26, but it may also be attached in other ways such as by welding. A connecting web 28 may be provided on shaft 2 between the rim portions 4. This preferably includes a ball bearing 30 and a compressible member 32 sandwiched between and bonded to steel rings 34 and 36. It will be seen that a slight gap 38 is provided between the rim portions 4 and a peripheral slot 40 is provided in compressible member 32 and ring 36 in alignment with gap 38. The ring 36 may or may not be secured to the rim portions 4, but there are advantages in securing the rim portions together. Rings 42 secured to shaft 2 by means of set screws 44 hold the webs 6 from moving apart.

In assembly, the web 28 is first positioned at the center of shaft 2. The webs 18 are then positioned on shaft 2 an equal distance from web 28 with their eccentricities arranged as desired but both in the same manner. The distance between web 28 and each 18 is selected according to the degree of centering desired. It will be seen that the closer the webs 18 are positioned to web 28, the lesser will be the angle between the axis of shaft 2 and the axis of rotation for the same eccentricity of the webs. The rim portions 4 end webs 6 attached thereto are then slid over the shaft 2 and the outside of member 36. If desired, the rim portions 4 are then secured to ring 36 as by a press fit. The rings 42 are then secured on shaft 2 by means of set screws 44. The roll is then ready for operation. It will be seen that the rim portions 4 rotate on axes that are arranged at the same angle with respect to the axis of shaft 2 and which intersect at a point midway between webs 18. The rim portions 4 are forced to deflect out of alignment with the axis of shaft 2 by reason of the eccentricity of the webs 18 and permitted to so bend by deflection in the webs 6. The web 28 including member 32 is formed concentric with the axis of shaft 2, but the member 32 under pressure of rim portions 4 will be forced out of shape so as to become eccentric as shown in the drawing. The webs 18 are not attached to rim portions 4 and it is preferred that clearance 46 be provided as shown. This provides greater centering action and quieter operation. The clearance 46 may vary, but is preferably about 1/16 of an inch. Above 3/16 of an inch problems will be present. In no instance should this clearance be greater than the permanent deflection of the rim portions 4. Under heavy loads or tension on the roll this clearance permits the angle between the center of rotation of the rim portions 4 and the axis of shaft 2 to increase, thus increasing the centering action. Otherwise, this roll functions in the same manner as the roll of U.S. Pat. No. 2,593,157.

Figure 2:
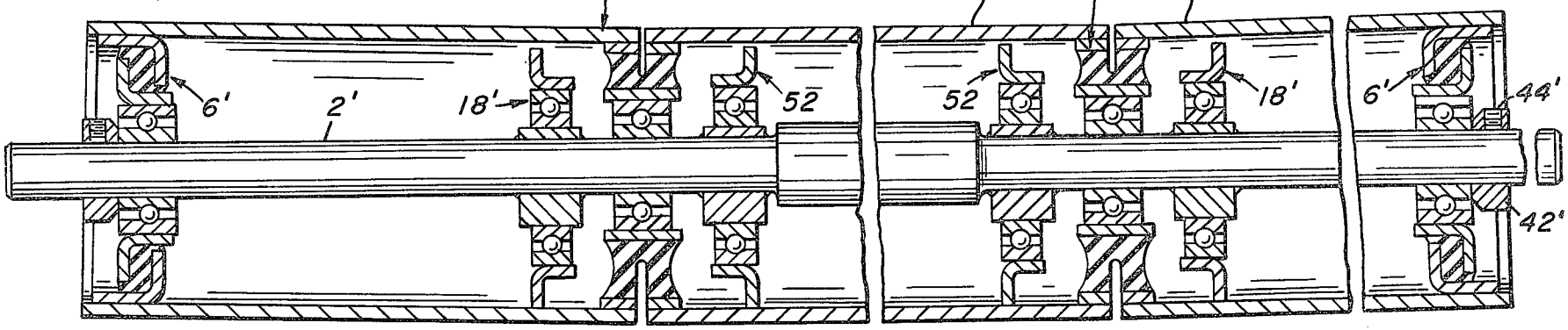
FIG. 2 is a view, similar to FIG. 1, showing a second embodiment of my invention.

In the embodiment of FIG. 2 a shaft 2', end rim portions 4', end webs 6', and inner webs 18' are provided corresponding to shaft 2, rim portions 4, end webs 6 and inner webs 18 of FIG. 1. A central rim portion 50 extends between the inner ends of rim portions 4' and is positioned by means of central webs 52 similar in construction to webs 18'. The eccentricity of webs 18' is compatible with that of webs 52. In other words the axis of rotation of web 18' is offset from the axis of shaft 2' less than the axis of rotation of web 52 to compensate for the deflection of rim portion 4' between web 18' and the inner end of the rim portion 4'. This is accomplished by making its hub less eccentric than the hub of web 52. Connecting webs 28', similar to web 28, are positioned at the gaps between rim portions 4' and 50. The length of rim portion 50 may vary as desired while rim portions 4' are of equal length.

In assembly, the webs 52 are first positioned on shaft 2' and welded or otherwise fastened thereto in the desired eccentric position. The rim portion 50 is then placed in position and the connecting webs 28' (if used) are then placed in position and secured to shaft 2'. The webs 18', rim portions 4' and webs 6' are then placed in position in the same manner as in the first embodiment with the eccentricity of webs 18' oriented in the same manner as webs 52'. Locking rings 42' are then secured on shaft 2' by set screws 44'. It will be seen that the construction and arrangement of this roll, except for the center rim section 50 and webs 52, is essentially the same as that of FIG. 1. The operation of the roll is otherwise the same as that in U.S. Pat. No. 2,817,940.

While two embodiments of my invention have been shown and described it will be apparent that other adaptions and modifications may be made within the scope of the following claims.

I claim:

1. A self-centering roll comprising a straight shaft; two tubular end rim portions surrounding said shaft; a pair of deflectible end webs mounted on said shaft, each of said webs including a bearing surrounding said shaft with its outer periphery spaced from the inner wall of its associated rim portion, and an outer member extending between and fastened to said bearing and said associated rim portion; and a pair of inner webs mounted on said shaft one adjacent the inner end of each tubular end rim portions, each of said inner webs including an eccentric hub attached to said shaft, a bearing surrounding said eccentric hub, and a radial member eccentric with respect to said shaft surrounding said bearing concentric therewith, the outside diameter of said eccentric radial member being only slightly less than the inside diameter of the associated end rim portion, the inner webs being arranged with the same eccentricity so that the two end rim portions will rotate on axes that intersect at a point between the inner webs and are arranged at the same angle with respect to the shaft axis.

2. A self-centering roll according to claim 1 in which the inner ends of said end rim portions are spaced a short distance apart.

3. A self-centering roll according to claim 2 including a connecting web extending between the inner ends of said end rim portions, said connecting web comprising a bearing surrounding said shaft, and a central compressible member extending between said bearing and said end rim portions, said central compressible member having a peripheral slot therein in alignment with the space between the inner ends of said end rim portions.

4. A self-centering roll according to claim 3 including means attaching said central compressible member to the adjacent ends of said rim portions.

5. A self-centering roll according to claim 1 in which the inner ends of said end rim portions are spaced apart a substantial distance, and a central tubular rim portion is provided therebetween with a narrow space between each end of the central rim portion and the end of the adjacent end rim portion.

6. A self-centering roll according to claim 5 including a pair of central webs mounted on said shaft one adjacent and within each end of said central rim portion, each of said central webs including an eccentric hub attached to said shaft, a bearing surrounding said hub, the outside diameter of said eccentric radial member being only slightly less than the inside diameter of said central rim portion, the central webs being arranged with their eccentricity compatible with that of said inner webs.

7. A self-centering roll according to claim 6 including a connecting web extending between the inner end of each end rim portion and the adjacent end of said central rim portion, each of said connecting webs comprising a bearing surrounding said shaft, and a central compressible member extending between said bearing and said central rim portion and adjacent end rim portion, each of said central compressible members having a peripheral slot therein in alignment with the space between the central rim portion and adjacent end rim portion.

8. A self-centering roll according to claim 7 including means attaching each of said central compressible members to the associated end rim portion and adjacent end of said central rim portion.

9. A self-centering roll according to claim 1 in which said outer member of each of said end webs includes a compressible member.

10. A self-centering roll according to claim 9 in which the inner ends of said end rim portions are spaced a short distance apart.

11. A self-centering roll according to claim 10 including a connecting web extending between the inner ends of said end rim portions, said connecting web comprising a bearing surrounding said shaft, and a central compressible member extending between said bearing and said end rim portions, said central compressible member having a peripheral slot therein in alignment with the space between the inner ends of said end rim portions.

12. A self-centering roll according to claim 11 including means attaching said central compressible member to the adjacent ends of said rim portions.

13. A self-centering roll according to claim 9 in which the inner ends of said end rim portions are spaced apart a substantial distance, and a central tubular rim portion is provided therebetween with a narrow space between each end of the central rim portion and the end of the adjacent end rim portion.

14. A self-centering roll according to claim 13 including a pair of central webs mounted on said shaft one adjacent and within each end of said central rim portion, each of said central webs including an eccentric hub attached to said shaft, a bearing surrounding said hub, the outside diameter of said eccentric radial member being only slightly less than the inside diameter of said central rim portion, the central webs being arranged with their eccentricity compatible with that of said inner webs.

15. A self-centering roll according to claim 14 including a connecting web extending between the inner end of each end rim portion and the adjacent end of said central rim portion, each of said connecting webs comprising a bearing surrounding said shaft, and a central compressible member extending between said bearing and said central rim portion and adjacent end rim portion, each of said central compressible members having a peripheral slot therein in alignment with the space between the central rim portion and adjacent end rim portion.

16. A self-centering roll according to claim 15 including means attaching each of said central compressible members to the associated end rim portion and adjacent end of said central rim portion.

* * * * *